US011101558B2

(12) United States Patent
Hallivuori

(10) Patent No.: US 11,101,558 B2
(45) Date of Patent: Aug. 24, 2021

(54) APPARATUS FOR A PHASE SHIFTER AND A METHOD OF MANUFACTURE OF AN APPARATUS FOR A PHASE SHIFTER

(71) Applicant: NOKIA SOLUTIONS AND NETWORKS OY, Espoo (FI)

(72) Inventor: Juha Hallivuori, Tampere (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 16/553,762

(22) Filed: Aug. 28, 2019

(65) Prior Publication Data

US 2020/0076076 A1 Mar. 5, 2020

(30) Foreign Application Priority Data

Aug. 28, 2018 (EP) ..... 18191306

(51) Int. Cl.
*H01Q 3/32* (2006.01)

(52) U.S. Cl.
CPC ..... *H01Q 3/32* (2013.01)

(58) Field of Classification Search
CPC ..... H01P 3/16; H01P 3/10; H01P 3/06; H01P 5/08; H01P 1/18; H01P 3/122; H01P 5/188; H01P 3/127; H01P 5/085; H01P 5/087; H01P 5/1022; H01P 5/107; H01P 1/10; H01P 1/182; H01P 1/184; H01P 1/22; H01P 3/02; H01Q 3/32
USPC ..... 343/907
See application file for complete search history.

(56) References Cited

U.S. PATENT DOCUMENTS 5,504,466 A * 4/1996 Chan-Son-Lint ..... H01P 1/184 333/159
2003/0043071 A1* 3/2003 Lilly ..... H01Q 3/2605 342/368
2005/0040916 A1* 2/2005 Park ..... H01P 1/2053 333/203
2005/0068116 A1 3/2005 Ham et al.
2013/0063229 A1 3/2013 Ferrari et al.
(Continued)

FOREIGN PATENT DOCUMENTS

WO WO 2007/084071 A1 7/2007
WO WO 2014/181239 A2 11/2014

OTHER PUBLICATIONS

Rehder, G. et al., *Development of a Slow-Wave MEMS Phase Shifter on CMOS Technology for Millimeter Wave Frequencies*, Microelectronic Engineering, Vol. 90 (Feb. 2012) 19-22.
(Continued)

*Primary Examiner* — Alexander H Taningco
*Assistant Examiner* — Amy X Yang
(74) *Attorney, Agent, or Firm* — Alston & Bird LLP

(57) ABSTRACT

There is provided an apparatus comprising a substrate having a first surface and a second surface, the substrate comprising a conductive signal line, a first conductive ground plane member and a second conductive ground plane member disposed in a first plane on the first surface of the substrate such that the conductive signal line is configured to convey a signal having a phase. The apparatus comprises a third conductive ground plane member disposed in a second plane, different from the first plane and means for causing relative movement between the third conductive ground plane member and the conductive signal line to cause a change in the phase of the signal.

21 Claims, 7 Drawing Sheets

(56) References Cited

U.S. PATENT DOCUMENTS

| | | | | |
|---|---|---|---|---|
| 2015/0372361 | A1 | 12/2015 | Abdellatif et al. | |
| 2017/0187086 | A1 | 6/2017 | Koul et al. | |
| 2018/0048044 | A1* | 2/2018 | Ou | H01P 3/006 |

OTHER PUBLICATIONS

Extended European Search Report for Application No. 18191306.2 dated Feb. 13, 2019, 9 pages.

Itoh, T., Overview of Quasi-Planar Transmission Lines, IEEE Transactions on Microwave Theory and Techniques, vol. 37, No. 2 (Feb. 1989), pp. 275-280.

Poplavko et al., Development of Piezo-Operated Dielectric Phase Shifter, IEEE 2006 16$^{th}$ International Crimean Conference "Microwave & Telecommunication Technology" (Sep. 2006) pp. 600-603.

* cited by examiner

APPARATUS FOR A PHASE SHIFTER AND A METHOD OF MANUFACTURE OF AN APPARATUS FOR A PHASE SHIFTER

CROSS-REFERENCE TO RELATED APPLICATIONS

This application claims priority to European Application No. 18191306.2, filed Aug. 28, 2018, the entire contents of which are incorporated herein by reference.

FIELD

The present application relates to an apparatus and, in particular but not exclusively, to an apparatus for a phase shifter for antenna arrays.

BACKGROUND

A communication system can be seen as a facility that enables communication sessions between two or more entities such as user terminals, base stations and/or other nodes by providing carriers between the various entities involved in the communications path. A communication system can be provided for example by means of a communication network and one or more compatible communication devices. The communication sessions may comprise, for example, communication of data for carrying communications such as voice, video, electronic mail (email), text message, multimedia and/or content data and so on. Non-limiting examples of services provided comprise one-way, two-way or multi-way calls, data communication or multimedia services and access to a data network system, such as the Internet.

In a wireless communication system at least a part of a communication session between at least two stations occurs over a wireless link. Examples of wireless systems comprise public land mobile networks (PLMN), satellite based communication systems and different wireless local networks, for example wireless local area networks (WLAN). The wireless systems can typically be divided into cells, and are therefore often referred to as cellular systems.

A user can access the communication system by means of an appropriate communication device or terminal. A communication device of a user may be referred to as user equipment (UE) or user device. A communication device is provided with an appropriate signal receiving and/or transmitting apparatus for enabling communications, for example enabling access to a communication network or communications directly with other users. The communication device may access a carrier provided by a station, for example a base station of a cell, and transmit and/or receive communications on the carrier.

The communication system and associated devices typically operate in accordance with a given standard or specification which sets out what the various entities associated with the system are permitted to do and how that should be achieved. Communication protocols and/or parameters which shall be used for the connection are also typically defined. One example of a communications system is UTRAN (3G radio). Other examples of communication systems are the long-term evolution (LTE) of the Universal Mobile Telecommunications System (UMTS) radio-access technology and so-called 5G or New Radio (NR) networks. NR is being standardized by the 3rd Generation Partnership Project (3GPP).

SUMMARY

In a first aspect there is provided an apparatus, comprising a substrate having a first surface and a second surface, the substrate comprising a conductive signal line, a first conductive ground plane member and a second conductive ground plane member disposed in a first plane on the first surface of the substrate such that the conductive signal line is configured to convey a signal having a phase and a third conductive ground plane member disposed in a second plane, different from the first plane and means for causing relative movement between the third conductive ground plane member and the conductive signal line to cause a change in the phase of the signal.

The second plane may oppose the second surface of the substrate.

The means for causing relative movement between the third conductive ground plane member and the conductive signal line may comprise means for moving the third ground plane member from a first configuration in which it is connected to the first ground plane member and the second ground plane member to at least one second configuration in which the third ground plane member is not connected to the first ground plane member and the second ground plane member.

In the first configuration, the third ground plane member may be connected to the first ground plane member and the second ground plane member using at least one via.

The means for causing relative movement between the third conductive ground plane member and the conductive signal line may comprise means for moving the third conductive ground plane member in a direction perpendicular to the first plane and the second plane.

The means for causing relative movement between the third conductive ground plane member and the conductive signal line may comprise means for moving the third conductive ground plane member at an angle to the first plane.

The means for causing relative movement between the third conductive ground plane member and the conductive signal line may comprise means for moving the third conductive ground plane member in increments relative to conductive signal line.

The means for moving the third conductive ground plane member relative to the conductive signal line may comprise a screw.

The means for moving the third conductive ground plane member relative to the conductive signal line may comprise a spring and at least one support.

The third conductive ground plane member may comprise at least one of an aluminium plate and a conductive area printed on a second substrate, different to the first substrate.

The conductive signal line may be connected between at least one element of an antenna array and radio frequency circuitry.

In a second aspect there is provided an electronic device comprising the apparatus according to the first aspect.

In a third aspect there is provided a method of manufacture comprising disposing, on a first surface of a substrate, a conductive signal line, a first conductive ground plane member and a second conductive ground plane member in a first plane, such that the conductive signal line is configured to convey a signal having a phase and providing a third conductive ground plane member disposed in a second plane, different from the first plane and means for causing relative movement between the third conductive ground plane member and the conductive signal line to cause a change in the phase of the signal.

The method of the third aspect may be used to manufacture an apparatus according to the first aspect or in the manufacture of a device according to the second aspect.

In the above, many different embodiments have been described. It should be appreciated that further embodiments may be provided by the combination of any two or more of the embodiments described above.

DESCRIPTION OF FIGURES

Embodiments will now be described, by way of example only, with reference to the accompanying Figures in which.

DETAILED DESCRIPTION

Before explaining in detail the examples, certain general principles of a wireless communication system and mobile communication devices are briefly explained with reference to FIGS. 1 and 2 to assist in understanding the technology underlying the described examples.

Figure 1:
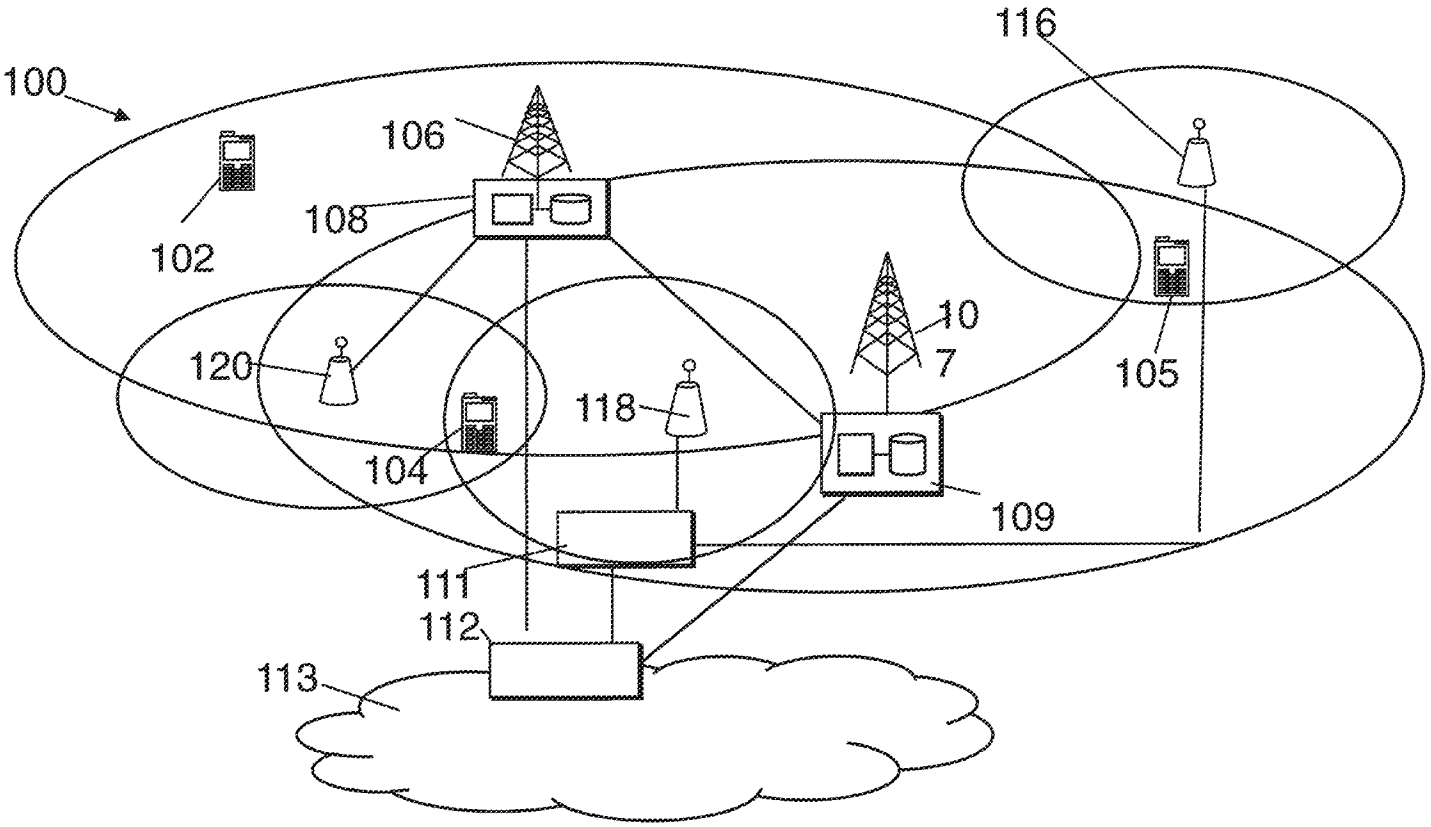
FIG. 1 shows a schematic diagram of an example communication system comprising a base station and a plurality of communication devices.

In a wireless communication system 100, such as that shown in FIG. 1, mobile communication devices or user equipment (UE) 102, 104, 105 are provided wireless access via at least one base station or similar wireless transmitting and/or receiving node or point. Base stations are typically controlled by at least one appropriate controller apparatus, so as to enable operation thereof and management of mobile communication devices in communication with the base stations. The controller apparatus may be located in a radio access network (e.g. wireless communication system 100) or in a core network (CN) (not shown) and may be implemented as one central apparatus or its functionality may be distributed over several apparatus. The controller apparatus may be part of the base station and/or provided by a separate entity such as a Radio Network Controller. In FIG. 1 control apparatus 108 and 109 are shown to control the respective macro level base stations 106 and 107. The control apparatus of a base station can be interconnected with other control entities. The control apparatus is typically provided with memory capacity and at least one data processor. The control apparatus and functions may be distributed between a plurality of control units. In some systems, the control apparatus may additionally or alternatively be provided in a radio network controller.

In FIG. 1 base stations 106 and 107 are shown as connected to a wider communications network 113 via gateway 112. A further gateway function may be provided to connect to another network.

The smaller base stations 116, 118 and 120 may also be connected to the network 113, for example by a separate gateway function and/or via the controllers of the macro level stations. The base stations 116, 118 and 120 may be pico or femto level base stations or the like. In the example, stations 116 and 118 are connected via a gateway 111 whilst station 120 connects via the controller apparatus 108. In some embodiments, the smaller stations may not be provided. Smaller base stations 116, 118 and 120 may be part of a second network, for example WLAN (Wireless Local Area Network) and may be WLAN APs (Access Point).

Figure 2:
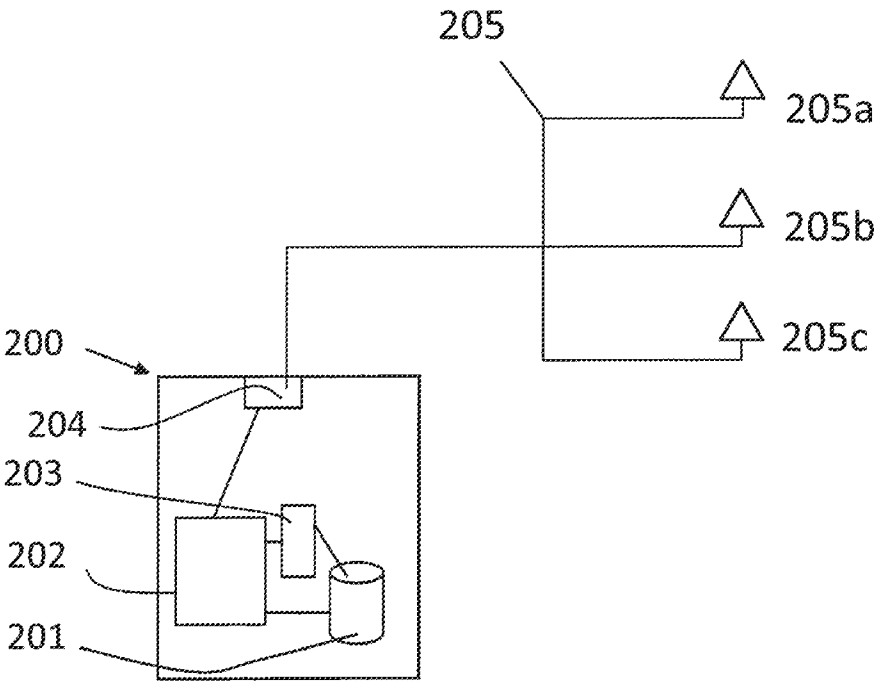
FIG. 2 shows a schematic diagram of an example control apparatus.

FIG. 2 shows an example of a control apparatus 200 for a communication system, for example to be coupled to and/or for controlling a station of an access system, such as a RAN (Radio Access Network) node, e.g. a base station, eNB (eNodeB) or gNB (next generation NodeB), a relay node or a core network node such as an MME (Mobility Management Entity) or S-GW (Serving Gateway) or P-GW (Packet Data Network Gateway), or a core network function such as AMF (Access and Mobility Function)/SMF (Session Management Function), or a server or host. The method may be implanted in a single control apparatus or across more than one control apparatus. The control apparatus may be integrated with or external to a node or module of a core network or RAN. In some embodiments, base stations comprise a separate control apparatus unit or module. In other embodiments, the control apparatus can be another network element such as a radio network controller or a spectrum controller. In some embodiments, each base station may have such a control apparatus as well as a control apparatus being provided in a radio network controller. The control apparatus 200 can be arranged to provide control on communications in the service area of the system. The control apparatus 200 comprises at least one memory 201, at least one data processing unit 202, 203 and an input/output interface 204. Via the interface 204 the control apparatus can be coupled to a receiver and a transmitter of the base station. The receiver and/or the transmitter may be implemented as a radio front end or a remote radio head.

The receiver and/or transmitter may comprise an array antenna 205. An array antenna comprises a plurality of antenna elements 205*a*, 205*b*, 205*c*, the outputs from which are combined or processed such that the plurality of antenna elements act as a single antenna.

The array antenna may be capable of beam steering. Beam steering is the control of the direction of a beam from an array antenna by adjusting the phase and amplitude input to each antenna element of the array.

Beam steering is becoming more important in antenna design. Phase shifters and associated digital systems to control antenna arrays for beam-steering exist. However, the cost and complexity of beam steering systems may prevent the use of beam steering in simple, cheap antennas (such as those used for customer premises equipment (CPE)). Although an antenna itself may be low-cost, the phase shifters and beam steering system add complexity and cost.

Control of beam direction may be achieved by tilting the antenna array in the desired direction, but that may not be possible or desired.

For example, in CPE, usage of vertical tilting is omitted, with only horizontal tilting used, to reduce cost and complexity. However, as antenna element count increases, some vertical tilt may be required to cover different landscapes.

Figure 3:
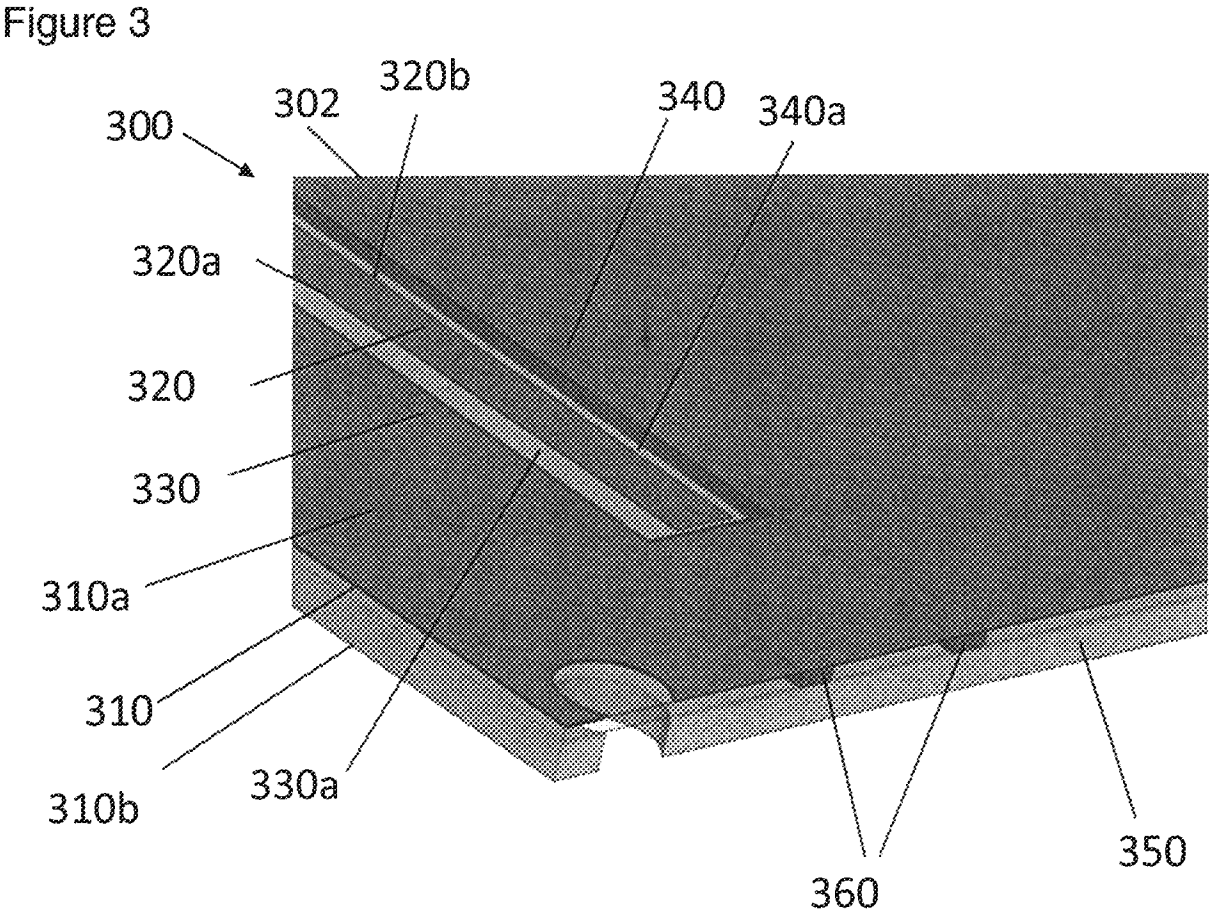
FIG. 3 shows a perspective view of an apparatus according to an embodiment in a first configuration.

FIG. 3 shows a perspective view of an apparatus 300 according to an embodiment which may be used as a phase shifter in an antenna array to provide beam steering.

The apparatus 300 includes a coplanar waveguide 302 comprising a printed circuit board (PCB). The coplanar waveguide (CPW) comprises a substrate 310. The substrate 310 may be a dielectric substrate. The substrate 310 has a thickness and first and second opposing major surfaces 310*a*, 310*b* which are substantially parallel to each other.

The coplanar waveguide 302 comprises a conductive signal line 320 disposed in a first plane on the first surface 310*a* of the substrate 310. A first conductive ground plane member 330 and a second conductive ground plane member 340 are disposed in the first plane on the first surface 310*a* of the substrate 310 such that the conductive signal line 320 is configured to convey a signal. The conductive signal line 320 may be connected between at least one element of an antenna array and radio frequency circuitry. A signal may travel in either direction along the signal line 320, meaning that it may be a transmit direction or a receive direction depending on whether the signal is coming from the antenna or from radio-frequency (RF) circuitry.

The first ground plane member 330 and the second ground plane member 340 may be disposed adjacent a first edge 320*a* and a second edge 320*b* of the conductive signal line 320, respectively, with a first gap 330*a* between the first edge 320*a* of the conductive signal line 320 and the first ground plane 330 and a second gap 340*a* between the second edge 320*b* of the conductive signal line 320 and the second ground plane 340. The first ground plane member 330 and second ground plane member 340 are connected to form an overall ground plane.

The apparatus 300 comprises a third conductive ground plane member 350, wherein the third conductive ground plane member 350 is disposed in a second plane, different from the first plane. The second plane may be parallel to the first plane. The second plane may be opposing the second surface 310*b* of the substrate 310. The third conductive ground plane member 350 may be provided as a printed conductive area on a second substrate, different to the first substrate 310 (i.e. a PCB). Alternatively, the third conductive ground plane member 350 may be provided as a piece of conductive sheet metal or plate (e.g. an aluminium plate).

In a first configuration of the apparatus, shown in FIG. 3, via areas connect the first conductive ground plane member 330 and the second conductive ground plane member 340 with the third conductive ground plane member 350. The via area is conductive and extend along the length of the conductive signal line. The via area may connect the top metal layer, M1, of the PCB comprising the CPW to the third conductive ground member 350 (e.g. a top layer M2 of a PCB comprising the third conductive ground plane member).

Via areas are shown in FIG. 3 in the form of strips 360. The thickness of the via strips 360 may be of the order of 1 or 2 mm and space the third ground plane member 350 from the first, or top surface, plane where the signal line 320 is formed. The via strips 360 may be formed of multiple circular vias.

Figure 4:
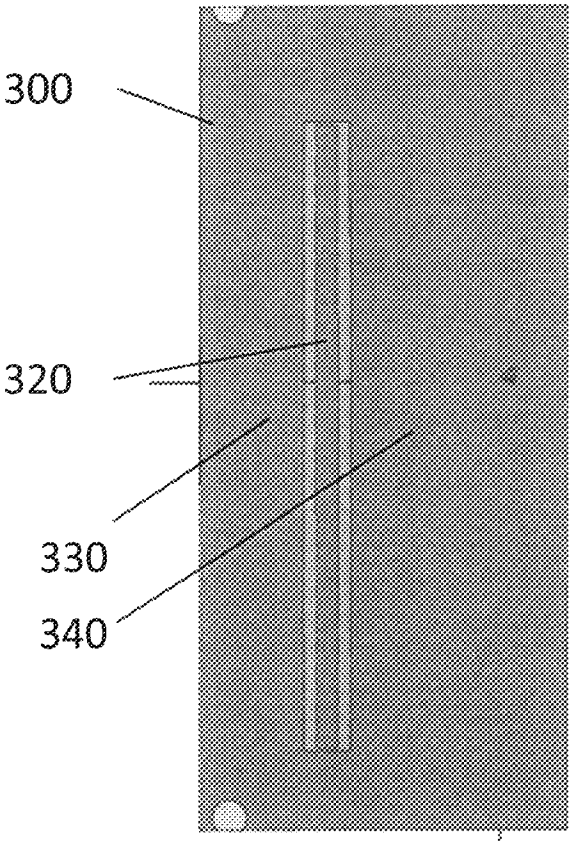
FIG. 4 shows a plan view of an apparatus according to an embodiment.

A plan view of the coplanar waveguide 302 is shown in FIG. 4.

The apparatus 300 comprises means for causing relative movement between the third conductive ground plane member 350 and the 310 conductive signal line 320 to cause a change in the phase of a signal transmitted along the conductive signal line 320.

The relative movement may be perpendicular to the first and second planes. Alternatively, the relative movement may comprise moving the third ground plane member 350 so that it is angled relative to the first plane (i.e. so that a first end of the third ground plane member 350 is closer to at least a first portion of the conductive signal line 320 than a second portion of the conductive signal line 320).

The relative movement between the third conductive ground plane member 350 and the conductive signal line 320 may comprise moving the third ground plane member 350 from a first configuration in which it is connected to the first ground plane member 330 and the second ground plane member 340 to at least one second configuration in which the third ground plane member 350 is disconnected from the first ground plane member 330 and the second ground plane member 340.

The relative movement of the third ground plane member 350 to the conductive signal line 320 causes the transmission line type to change from that of a coplanar waveguide (in the second configuration) to that similar to a conductor backed coplanar waveguide (in the first configuration) and vice versa.

In the first configuration, as shown in FIG. 3, the conductive signal line 320 acts as a microstrip line due to the ground plane 350 directly underneath the signal line 320 and connected to the first ground plane member 330 and the second ground plane member 340.

Figure 5:
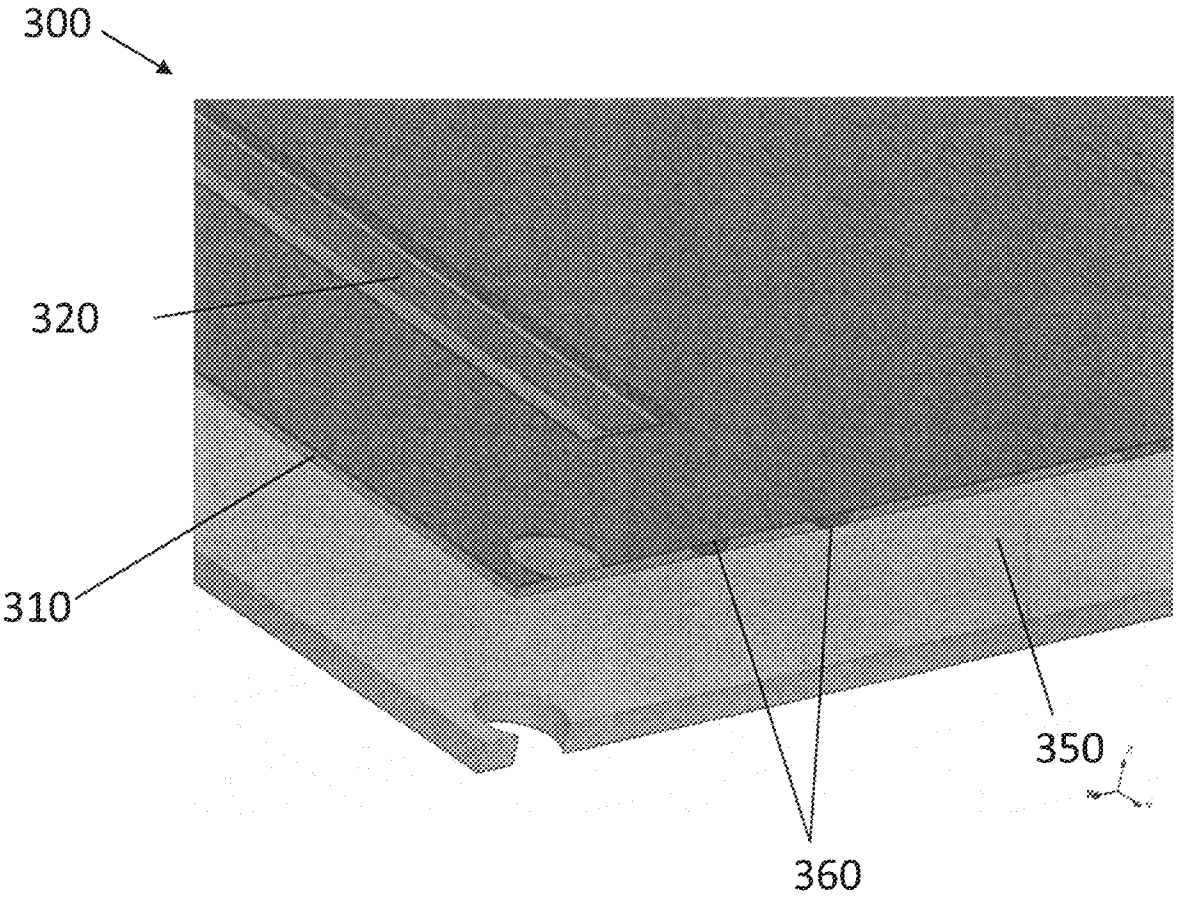
FIG. 5 shows a perspective view of an apparatus according to an embodiment in a second configuration.

FIG. 5 shows a perspective view of the apparatus 300 in a second configuration in which the third conductive ground plane member 350 has been disconnected from the vias 360 (so that the third conductive ground plane member 350 is no longer coupled to the first ground plane member 330 and second ground plane member 340) so that there is an air gap (where air has a dielectric constant of 1) between the third ground plane member 350 and the conductive signal line 320. As the distance between the third ground plane member 350 and the conductive signal line 320 is increased, the effect of the third ground plane member 350 changes the phase behaviour in the conductive signal line 320.

The position of the third conductive ground plane member 350 affects the phase behaviour in the conductive signal line 320. The achieved phase shift may be 110°. An equivalence when used in a 1×5 antenna array of 30° tilting may be achieved, which is sufficient to cover landscape requirements. The phase range may be increased further, but this increase may result in undesirable variation of the characteristic impedance of the conductive signal line 320.

In the example shown in FIG. 5, the third conductive plane member 350 has been moved away from the conductive signal line 320 along the z-axis.

The input/output of the conductive signal line 320 may be connected to an antenna element of an array antenna. The signal line is connected between the antenna array and radio frequency (RF) circuitry (which may be one or more of a receiver and a transmitter, excluding any intervening components). A device may comprise more than one apparatus, i.e., more than one conductive signal line 320, each signal line feeding a separate element of the antenna array.

The means for causing relative movement between the third conductive ground plane member 350 and the conductive signal line 320 may comprise means for moving the third conductive ground plane 350 at least a first distance from the conductive signal line 320. The means for moving the third conductive ground plane member 350 relative to the conductive signal line 320may comprise means for moving the third conductive ground plane member 350 in increments relative to the conductive signal line 320.

Figure 6:
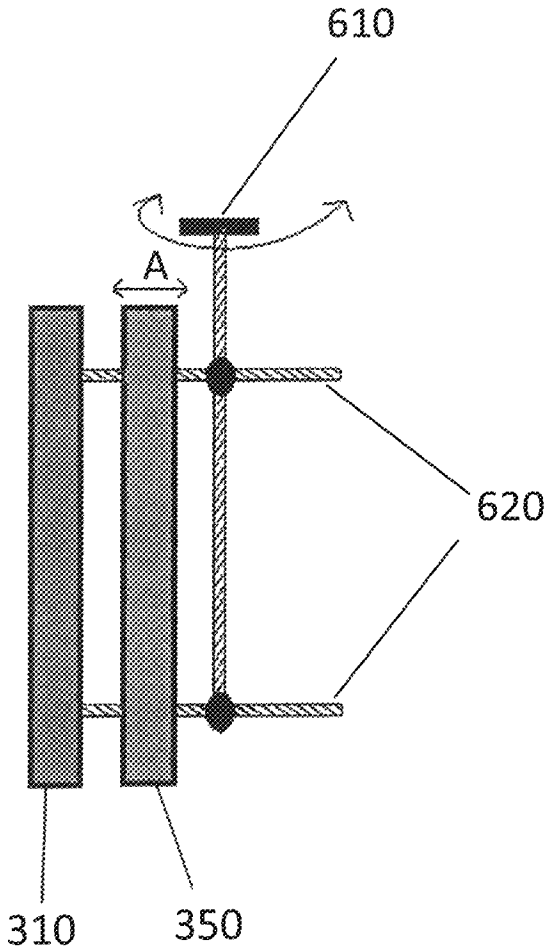
FIG. 6 shows a cross section of an apparatus according to an embodiment.

In an example embodiment, shown in FIG. 6, the means for causing relative movement between the third conductive ground plane member 350 and the conductive signal line 320 comprises a screw 610. The screw 610 may be rotated by a user which causes movement of the third conductive plane member 350 as shown by arrow A. The third conductive ground plane member 350 may be moved along guide rails 620.

Figure 7:
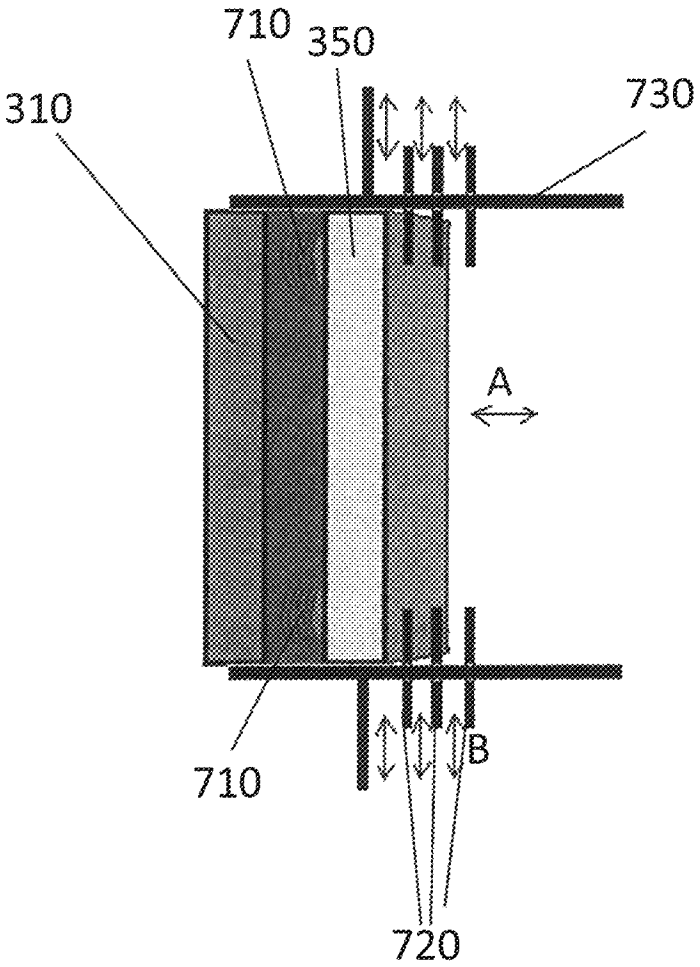
FIG. 7 shows a cross section of an apparatus according to an alternative embodiment.

In another embodiment, shown in FIG. 7, the means for causing relative movement between the third conductive ground plane member 350 and the conductive signal line 320 comprises at least one spring 710. The apparatus comprises at least one support 720 for the third conductive ground plane 350 inserted along the direction shown by arrow B into a corresponding slot in a frame 730 for supporting the third conductive ground plane member at a selected distance from the conductive signal line 320.The spring 710 maintains the position of the third ground plane member 350 by exerting a force in direction A towards the support 720. The support 720 may comprise a pair of supports or a single support. Although three pairs of supports 720 are shown in position in FIG. 7, only a support for a selected position will be inserted into a corresponding slot in use.

There is provided a method of manufacture of an apparatus comprising disposing, on a first surface 310*a* of a substrate 310, a conductive signal line 320, a first conductive ground plane member 330 and a second conductive ground plane member 340 in a first plane, such that the conductive signal line 320 is configured to convey a signal having a phase and providing a third conductive ground plane member 350 disposed in a second plane, different from the first plane and means for causing relative movement between the third conductive ground plane member 350 and the conductive signal line 320 to cause a change in the phase of the signal.

It should be understood that the apparatuses may comprise or be coupled to other units or modules etc., such as radio parts or radio heads, used in or for transmission and/or reception. Although the apparatuses have been described as one entity, different modules and memory may be implemented in one or more physical or logical entities.

An electronic device comprising the apparatus may be provided. The electronic device may be a wireless communications device, a portable electronic device, a stationary electronic device, a network device, a computer device, a navigation device, an audio device, a video device and an entertainment device.

It is noted that whilst embodiments have been described in relation to consumer premises equipment, similar principles can be applied in relation to other networks and communication systems where beam steering is used. Therefore, although certain embodiments were described above by way of example with reference to certain example architectures for wireless networks, technologies and standards, embodiments may be applied to any other suitable forms of communication systems than those illustrated and described herein.

It is also noted herein that while the above describes example embodiments, there are several variations and modifications which may be made to the disclosed solution without departing from the scope of the present invention.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Computer software or program, also called program product, including software routines, applets and/or macros, may be stored in any apparatus-readable data storage medium and they comprise program instructions to perform particular tasks. A computer program product may comprise one or more computer-executable components which, when the program is run, are configured to carry out embodiments. The one or more computer-executable components may be at least one software code or portions of it.

The software may be stored on such physical media as memory chips, or memory blocks implemented within the processor, magnetic media such as hard disk or floppy disks, and optical media such as for example DVD and the data variants thereof, CD. The physical media is a non-transitory media.

The memory may be of any type suitable to the local technical environment and may be implemented using any suitable data storage technology, such as semiconductor based memory devices, magnetic memory devices and systems, optical memory devices and systems, fixed memory and removable memory. The data processors may be of any type suitable to the local technical environment, and may comprise one or more of general purpose computers, special purpose computers, microprocessors, digital signal processors (DSPs), application specific integrated circuits (ASIC), FPGA, gate level circuits and processors based on multi core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

The foregoing description has provided by way of non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims. Indeed, there is a further embodiment comprising a combination of one or more embodiments with any of the other embodiments previously discussed.

That which is claimed is:

1. An apparatus comprising:

a substrate having a first surface and a second surface, the substrate comprising a conductive signal line, a first conductive ground plane member and a second conductive ground plane member disposed in a first plane on the first surface of the substrate such that the conductive signal line is configured to convey a signal having a phase, wherein the first conductive plane member and second conductive plane member are connected to form an overall ground plane;

a third conductive ground plane member disposed in a second plane, different from the first plane; and means for causing relative movement between the third conductive ground plane member and the conductive signal line to cause a change in the phase of the signal.

2. An apparatus according to claim 1, wherein the relative movement between the third conductive ground plane member and the conductive signal line causes a change in transmission line type between a coplanar waveguide and a conductor backed coplanar waveguide.

3. An apparatus according to claim 1, wherein the second plane opposes the second surface of the substrate.

4. An apparatus according to claim 1, wherein the means for causing relative movement between the third conductive ground plane member and the conductive signal line comprises means for moving the third ground plane member from a first configuration in which it is connected to the first ground plane member and the second ground plane member to at least one second configuration in which the third ground plane member is not connected to the first ground plane member and the second ground plane member.

5. An apparatus according to claim 4, wherein, in the first configuration, the third ground plane member is connected to the first ground plane member and the second ground plane member using at least one via.

6. An apparatus according to claim 1, wherein the means for causing relative movement between the third conductive ground plane member and the conductive signal line comprises means for moving the third conductive ground plane member in a direction perpendicular to the first plane and the second plane.

7. An apparatus according to claim 1, wherein the means for causing relative movement between the third conductive ground plane member and the conductive signal line comprises means for moving the third conductive ground plane member at an angle to the first plane.

8. An apparatus according to claim 1, wherein the means for causing relative movement between the third conductive ground plane member and the conductive signal line comprises means for moving the third conductive ground plane member in increments relative to conductive signal line.

9. An apparatus according to claim 1, wherein the means for moving the third conductive ground plane member relative to the conductive signal line comprises a screw.

10. An apparatus according to claim 1, wherein the means for moving the third conductive ground plane member relative to the conductive signal line comprises a spring and at least one support.

11. An apparatus according to claim 1, wherein the third conductive ground plane member comprises at least one of an aluminium plate and a conductive area printed on a second substrate, different to the first substrate.

12. An apparatus according to claim 1, wherein the conductive signal line is connected between at least one element of an antenna array and radio frequency circuitry.

13. An electronic device comprising the apparatus of claim 1.

14. A method of manufacture comprising:

disposing, on a first surface of a substrate, a conductive signal line, a first conductive ground plane member and a second conductive ground plane member in a first plane, such that the conductive signal line is configured to convey a signal having a phase, wherein the first conductive plane member and second conductive plane member are connected to form an overall ground plane; and providing a third conductive ground plane member disposed in a second plane, different from the first plane and one of (i) a screw or (ii) a spring and at least one support configured to cause relative movement between the third conductive ground plane member and the conductive signal line to cause a change in the phase of the signal.

15. An apparatus comprising:

a substrate having a first surface and a second surface, the substrate comprising a conductive signal line, a first conductive ground plane member and a second conductive ground plane member disposed in a first plane on the first surface of the substrate such that the conductive signal line is configured to convey a signal having a phase, wherein the first conductive plane member and second conductive plane member are connected to form an overall ground plane;

a third conductive ground plane member disposed in a second plane, different from the first plane; and one of (i) a screw or (ii) a spring and at least one support, configured to cause relative movement between the third conductive ground plane member and the conductive signal line to cause a change in the phase of the signal.

16. An apparatus according to claim 15, wherein the relative movement between the third conductive ground plane member and the conductive signal line causes a change in transmission line type between a coplanar waveguide and a conductor backed coplanar waveguide.

17. An apparatus according to claim 15, wherein the one of (i) the screw or (ii) the spring and the at least one support, is further configured to move the third ground plane member from a first configuration in which it is connected to the first ground plane member and the second ground plane member to at least one second configuration in which the third ground plane member is not connected to the first ground plane member and the second ground plane member.

18. An apparatus according to claim 17, wherein, in the first configuration, the third ground plane member is connected to the first ground plane member and the second ground plane member using at least one via.

19. An apparatus according to claim 15, wherein the one of (i) the screw or (ii) the spring and the at least one support, is further configured to move the third conductive ground plane member in a direction perpendicular to the first plane and the second plane.

20. An apparatus according to claim 15, wherein the one of (i) the screw or (ii) the spring and the at least one support, is further configured to move the third conductive ground plane member at an angle to the first plane.

21. An electronic device comprising the apparatus of claim 15.

* * * * *